United States Patent [19]

Chern et al.

[11] Patent Number: 5,001,219

[45] Date of Patent: Mar. 19, 1991

[54] HIGH MODULUS POLY-P-PHENYLENE TEREPHTHALAMIDE FIBER

[75] Inventors: Terry S. Chern, Richmond, Va.; Stephan C. De La Veaux; Jacob Lahijani, both of Wilmington, Del.; James E. Van Trump, Hockessin, Del.

[73] Assignee: E. I. du Pont de Nemours and Company, Wilmington, Del.

[21] Appl. No.: 300,771

[22] Filed: Jan. 23, 1989

Related U.S. Application Data

[60] Division of Ser. No. 41,589, Apr. 27, 1987, Pat. No. 4,883,634, which is a continuation-in-part of Ser. No. 868,667, May 30, 1986, abandoned.

[51] Int. Cl.[5] ..... C08G 69/46

[52] U.S. Cl. ..... 528/348; 528/183; 528/337; 528/344

[58] Field of Search ..... 528/348, 183, 337, 344

[56] References Cited

U.S. PATENT DOCUMENTS

| | | | |
|---|---|---|---|
| 3,063,966 | 11/1962 | Kwolek | 260/78 |
| 3,673,143 | 6/1972 | Bair et al. | 260/30.2 |
| 3,817,941 | 6/1974 | Bair et al. | 260/78 |
| 3,862,897 | 1/1975 | Gattus et al. | 264/216 |
| 3,869,429 | 3/1975 | Blades | 260/78 S |
| 3,869,430 | 3/1987 | Blades | 260/78 S |
| 4,346,215 | 8/1982 | Garlington et al. | 528/348 |
| 4,374,977 | 2/1983 | Fujiwara et al. | 528/348 |
| 4,374,978 | 2/1983 | Fujiwara et al. | 528/348 |
| 4,507,467 | 3/1985 | Shimada et al. | 528/348 |
| 4,539,393 | 9/1985 | Tamuro et al. | 528/348 |
| 4,560,743 | 12/1985 | Fujiwara et al. | 528/348 |

FOREIGN PATENT DOCUMENTS

| | | |
|---|---|---|
| 55-11763 | 3/1980 | Japan . |
| 55-11764 | 3/1980 | Japan . |
| 59-192713 | 11/1984 | Japan . |
| 2044668 | 3/1980 | United Kingdom . |
| 2044669 | 3/1980 | United Kingdom . |

OTHER PUBLICATIONS

Journal of East China Institute of Textile Science and Technology, vol. 10, No. 2, 1984, pp. 30–34.

Journal of East China Institute of Textile Science and Technology, vol. 10, No. 2 (1984), pp. 30–34.

*Primary Examiner*—Harold D. Anderson

[57] ABSTRACT

High modulus, high tenacity fibers of poly-p-phenylene terephthalamide (PPD-T) are disclosed along with a fiber heat treating process for increasing the inherent viscosity and the crystallinity index of the PPD-T. Never-dried fibers swollen with water of controlled acidity are heated beyond dryness.

2 Claims, 1 Drawing Sheet

HIGH MODULUS POLY-P-PHENYLENE TEREPHTHALAMIDE FIBER

This is a division of application Ser. No. 041,589, filed Apr. 27, 1987, now U.S. Pat. No. 4,883,634, which was a continuation-in-part of application Ser. No. 868,667, filed May 30, 1986, now abandoned.

BACKGROUND OF THE INVENTION

1. Field of the Invention

Poly-p-phenylene terephthalamide fibers, long known for their light weight, high strength, and high modulus, have found wide acceptance in a great number of applications requiring their unique combination of properties. The wide acceptance has, however, given rise to a demand and need for fibers having still higher strength and modulus for use in still more demanding applications. Fibers having decreased solubility and chemical reactivity and increased overall crystallinity and resistance to moisture regain have been sought and are in demand.

2Description of the Prior Art

U.S. Pat. No. 3,869,430, issued Mar. 4, 1975 on the application of H. Blades, discloses fibers of poly-p-phenylene terephthalamide and processes for making the polymer and the fibers. That patent is particularly concerned with a process for heat treating such fibers after the fibers have been dried. That patent discloses, generally, that fibers could be heat treated whether wet or dry; but, in the examples, teaches heat treatment only of dried fibers and, elsewhere in the specification, cautions against heat treating fibers at excessive heat for excessive time with the warning that decreased tenacity and decreased polymer inherent viscosity will result.

Japanese Patent Publications No. 55-11763 and 55-11764 published Mar. 27, 1980, disclose fibers of poly-p-phenylene terephthalamide having high modulus and high tenacity but with polymer exhibiting only moderate inherent viscosity. The processes of those publications are particularly concerned with a fiber-drawing step performed after coagulating the spun polymer and before drying the fibers. In the drawing step, the fibers are actually stretched to 20 to 80 or 90% of the maximum stretch attainable before break. After the stretching, the fibers are dried at various times and at temperatures above about 300 degrees and as high as 600 degrees for three seconds. The inherent viscosity of the polymer of fibers so-made is always disclosed to be less than the inherent viscosity of the starting polymer and there is no suggestion that the inherent viscosity might be increased by any heat treatment.

The Journal of East China Institute of Textile Science and Technology, Vol. 10, No. 2 (1984), pp. 30–34, discloses heat treatment of fibers under very slight tension. There is teaching that the treatment causes decomposition, branching, and cross-association with accompanying increases in molecular weight. Neither fiber modulus nor degree of crystallinity is mentioned.

SUMMARY OF THE INVENTION

A process is provided by this invention for manufacturing a poly-p-phenylene terephthalamide fiber having high modulus and high tenacity wherein a wet, water-swollen, fiber is exposed to a heated atmosphere, and the fiber, during exposure, is subjected to a tension. The swollen fibers, preferably, have about 20 to 100 percent water, based on dried fiber material, and the atmosphere is usually heated at 500 to 660 degrees with exposure of the fiber for 0.25 to 12 seconds. The tension on the fibers is about 1.5 to 4 grams per denier (gpd). There is, also, provision for controlling the acidity or basicity of the water-swollen (never-dried) fibers to affect change in the inherent viscosity and tenacity of the polymer during the heat treatment. Inherent viscosity of the polymer after the heat treatment is high; more than 5.5 and as much as 20 or more; and is increased in the heat treatment. In order to maintain satisfactory process operability and product properties, the basicity is maintained at less than about 10 and the acidity is maintained at less than about 60. Basicity of less than about 2 and acidity of less than about 1.0 are preferred. Crystallinity Index of the heat treated polymer is high; at least 70% and as. much as 85%.

In one embodiment of the invention, an entrainment jet is used for application of hot gas to dry and treat the swollen fibers in an efficient and effective manner. The process is very fast and, as a result, the product of the jet embodiment of the process is a fiber having a Crystallinity Index of greater than 75%. For use of the jet embodiment, it is preferred that the swollen fiber should be exposed to a heated atmosphere at 500 to 660 centigrade degrees for about 0.25 to 3 seconds, and most preferably about 0.5 to 2 seconds. In the most preferable range, there is some allowance made for different sizes of yarns—the range is most preferably 0.5 to 1 second for 400 denier yarns and 0.5 to 2 seconds for 1200 denier yarns.

In another embodiment of the invention, an oven is used for application of radiant heat to cause slower drying of the swollen fibers; and, as a result, the product of the oven embodiment is a fiber having an inherent viscosity of more than about 6.5. For use of the oven embodiment, it is preferred that the swollen fiber should be exposed to a heated atmosphere at 500 to 660 degrees for about 3 to 12 seconds, and most preferably at 550 to 660 degrees for about 5 to 12 seconds, with less time required for low denier yarn at a given temperature. For purposes of this invention, radiant heating of the oven embodiment means that at least 75 percent of the heat energy absorbed by the water-swollen yarn is radiant heat energy.

In the other embodiments, there can be combinations of the above heat treatment embodiments which yield high modulus, high tenacity fibers with, both, an increased inherent viscosity and an increased Crystallinity Index.

DETAILED DESCRIPTION OF THE INVENTION

Figure 1:
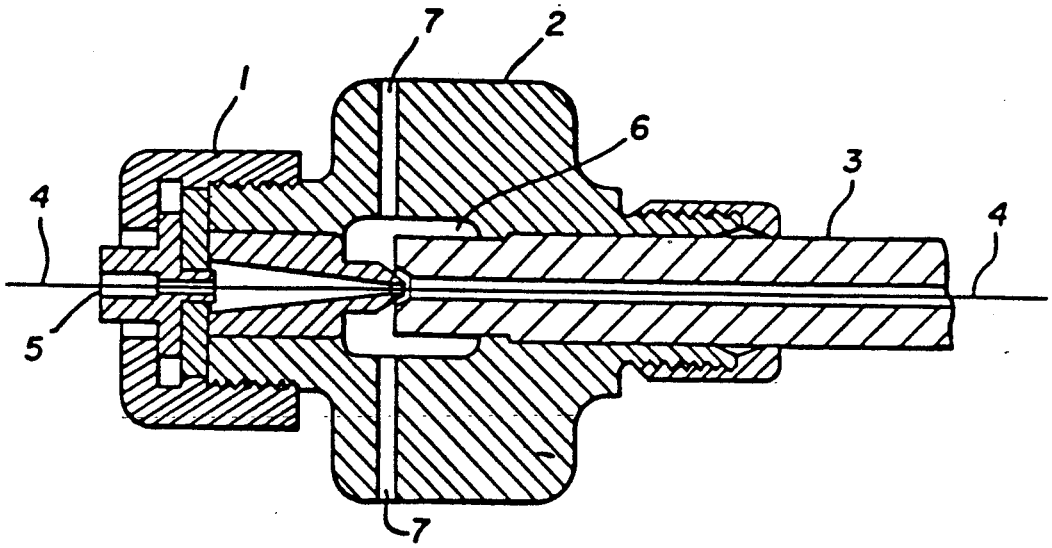

The present invention is based on a treatment of poly-p-phenylene terephthalamide fibers which, quite unexpectedly, gives rise to fibers of high modulus and Crystallinity Index while permitting controlled increase of the ultimate inherent viscosity. The invention permits manufacture of high modulus fibers of poly-p-phenylene terephthalamide, having inherent viscosity of greater than 6.5 and Crystallinity Index of greater than about 75%.

By "poly-p-phenylene terephthalamide" is meant the homopolymer resulting from mole-for-mole polymerization of p-phenylene diamine and terephthaloyl chloride and, also, copolymers resulting from incorporation of small amounts of other aromatic diamine with the p-phenylene diamine and of small amounts of other aromatic diacid chloride with the terephthaloyl chloride. Examples of acceptable other aromatic diamines include m-phenylene diamine, 4,4'-diphenyldiamine, 3,3'-diphenyldiamine, 3,4'-diphenyldiamine, 4,4'-oxydiphenyldiamine, 3,3'-oxydiphenyldiamine, 3,4'-oxydiphenyldiamine, 4,4'-sulfonyldiphenyldiamine, 3,3'-sulfonyldiphenyldiamine, 3,4'-sulfonyldiphenyldiamine, and the like. Examples of acceptable other aromatic diacid chlorides include 2,6-naphthalenedicarboxylic acid chloride, isophthaloyl chloride, 4,4'-oxydibenzoyl chloride, 3,3'-oxydibenzoyl chloride, 3,4'-oxydibenzoyl chloride, 4,4'-sulfonyldibenzoyl chloride, 3,3'-sulfonyldibenzoyl chloride, 3,4'-sulfonyldibenzoyl chloride, 4,4'-dibenzoyl chloride, 3,3'-dibenzoyl chloride, 3,4'-dibenzoyl chloride, and the like. As a general rule, other aromatic diamines and other aromatic diacid chlorides can be used in amounts up to as much as about 10 mole percent of the p-phenylene diamine or the terephthaloyl chloride, or perhaps slightly higher, provided only the other diamines and diacid chlorides have no reactive groups which interfere with the polymerization reaction. Poly-p-phenylene terephthalamide fibers which include such small amounts of other diacids or diamines and which are heat treated by this invention, may exhibit physical properties slightly different from those which would have been obtained had no other diacids or diamines been present.

The polymer can be conveniently made by any of the well known polymerization processes such as those taught in U.S. Pat. No. 3,063,966 and U.S. Pat. No. 3,869,429. One process for making the polymer includes dissolving one mole of p-phenylene diamine in a solvent system comprising about one mole of calcium chloride and about 2.5 liters of N-methyl-2-pyrrolidone and then adding one mole of terephthaloyl chloride with agitation and cooling. The addition of the diacid chloride is usually accomplished in two steps—the first addition step being about 25–35 weight percent of the total with the second addition step occurring after the system has been stirred for about 15 minutes. Cooling is applied to the system after the second addition step to maintain the temperature below about 60° C. Under forces of continued agitation, the polymer gels and then crumbles; and, after a few hours or more, the resulting crumb-like polymer is ground and washed several times in water and dried in an oven at about 100°–150° C.

Molecular weight of the polymer is dependent upon a multitude of conditions. For example, to obtain polymer of high molecular weight, reactants and solvent should be free from impurity and the water content of the total reaction system should be as low as possible —no more, and preferably less, than 0.03 weight percent. Care should be exercised to assure the use of equimolar amounts of the diamine and the diacid chloride because only a slight imbalance in the reactant materials will result in a polymer of low molecular weight While it may be preferred that inorganic salts be added to the solvent to assist in maintaining a solution of the polymer as it is formed, quaternary ammonium salts have, also, been found to be effective in maintaining the polymer solution. Examples of useful quaternary ammonium salts include methyl-tri-n-butyl ammonium chloride, methyl-tri-n-propyl ammonium chloride, tetra-n-propyl ammonium chloride, tetra-n-butyl ammonium chloride, and the like.

Fibers are made in accordance with the present invention by extruding a dope of the polymer under certain conditions. The dope can be prepared by dissolving an adequate amount of the polymer in an appropriate solvent. Sulfuric acid, chlorosulfuric acid, fluorosulfuric acid and mixtures of these acids can be identified as appropriate solvents. Sulfuric acid is much the preferred solvent and must be used at a concentration of 98% or greater to avoid undue degradation of the polymer. The polymer should be dissolved in the dope in the amount of at least 30, preferably more than 40, grams of polymer per 100 milliliters of solvent. The densities of the acid solvents are as follows $H_2SO_4$, 1.83 g/ml; $HSO_3Cl$, 1.79 g/ml; and $HSO_3F$, 1.74 g/ml.

Before dissolving the polymer to make the spinning dope, the polymer should be carefully dried to, preferably, less than one weight percent water; and the polymer and the solvent should be combined under dry conditions. Dopes should be mixed and held in the spinning process at as low a temperature as is practical to keep them liquid in order to reduce degradation of the polymer. Exposure of the dopes to temperatures of greater than 90° C. should be minimized The dope, once prepared, can be used immediately or stored for future use. If stored, the dope is preferably frozen and stored in solid form in an inert atmosphere such as under a dry nitrogen blanket. If the dope is to be used immediately, it can conveniently be made continuously and fed directly to spinnerets. Continuous preparation and immediate use minimizes degradation of the polymer in the spinning process.

The dopes are, typically, solid at room temperature and behave, in spinning, like polymer melts. For example, a dope of 45 grams of the polymer with an inherent viscosity of about 5.4 in 100 milliliters of 100% sulfuric acid may exhibit a bulk viscosity of about 900 poises at 105° C. and about 1000 poises at 80° C., measured at a shear rate of 20 $sec^{-1}$, and would solidify to an opaque solid at about 70° C. The bulk viscosity of dopes made with a particular polymer increases with molecular weight of the polymer for given temperatures and concentrations.

Dopes can generally be extruded at any temperature where they are sufficiently fluid. Since the degree of degradation is dependent upon time and temperature, temperatures below about 120° C. are usually used and temperatures below about 90° C. are preferable. If higher temperatures are required or desired for any reason, processing equipment should be designed so that the dope is exposed to the higher temperatures for a minimum time.

Dopes used to make the fibers of this invention are optically anisotropic, that is microscopic regions of the dope are birefringent and a bulk sample of the dope depolarizes plane-polarized light because the light transmission properties of the microscopic regions of the dope vary with direction. It is believed to be important that the dopes used in this invention must be anisotropic, at least in part.

Fibers of the present invention can be made using the conditions specifically set out in U.S. Pat. No. 3,869,429. Dopes are extruded through spinnerets with orifices ranging from about 0.025 to 0.25 mm in diameter, or perhaps slightly larger or smaller. The number, size, shape, and configuration of the orifices are not critical. The extruded dope is conducted into a coagulation bath through a noncoagulating fluid layer. While in the fluid layer, the extruded dope is stretched from as little as 1 to as much as 15 times its initial length (spin stretch factor). The fluid layer is generally air but can be any any other inert gas or even liquid which is a noncoagulant for the dope The noncoagulating fluid layer is generally from 0.1 to 10 centimeters in thickness.

The coagulation bath is aqueous and ranges from pure water, or brine, to as much as 70% sulfuric acid. Bath temperatures can range from below freezing to about 28° C. or, perhaps, slightly higher. It is preferred that the temperature of the coagulation bath be kept below about 10° C., and more preferably, below 5° C., to obtain fibers with the highest initial strength After the extruded dope has been conducted through the coagulation bath, the dope has coagulated into a water-swollen fiber and is ready for drying and heat treatment The fiber includes about 20 to 100% percent aqueous coagulation medium, based on dry fiber material, and, for the purposes of this invention, must be thoroughly washed to remove the proper amount of salt and acid from the interior of the swollen fiber. It is now understood that fiber-washing solutions can be pure water or they can be slightly alkaline. Washing solutions should be such that the liquid in the interior of the swollen fiber should have an acidity less than 60 and preferably less than 10 and a basicity less than 10 and preferably less than 2 depending upon the conditions of the heat treatment and the desired final inherent viscosity of the fiber product.

It is now believed that heat treatment of never-dried poly-p-phenylene terephthalamide fibers results in alteration of the polymer in the fiber in that the heat treatment causes a complex combination of polymerization, depolymerization, branching and crosslinking reactions.

At temperatures from above 500° C. to about 660° C., at the relatively short exposure times of this invention (0.25–12 sec), the predominant reaction is believed to be branching and cross-linking which lead to fibers with higher molecular weights and higher inherent viscosities; these reactions are believed to be catalyzed by acids. Thus, poly-p-phenylene terephthalamide never-dried fibers having an inherent viscosity of about 5.5 and containing about 9 milliequivalents of acid or less, showed little or no significant change in inherent viscosity when heated at oven temperatures of 450°–500° C. for 6–9 seconds. However, when heated at oven temperatures of 550°–660° C., these same never-dried fibers showed an unexpected and pronounced increase in inherent viscosity up to or greater than 6.5, and the moduli increased to about 1100 gpd or higher, while tenacities were maintained at 18 gpd or higher. By contrast, when poly-p-phenylene terephthalamide fibers containing about 150 milliequivalents of acid per kg of fiber were heated in an oven even at temperatures as low as 410° C. for 5 sec, the inherent viscosities of the fibers were increased from about 5.5 to over 7, while fiber tenacity deteriorated from about 25 gpd to less than 16 gpd, below the range of interest of this invention.

Within the range of temperatures (500°–660° C.) and exposure times (0.25–12 sec) of this invention, acidity of up to about 60 meq of acid per kg of yarn is acceptable. Within that acidity limit, process operability and product properties are acceptable. The upper limit of 60 acidity approximately corresponds to what is believed to be the sum of acid groups attached to poly-p-phenylene terephthalamide polymer. The acid groups are made up of carboxylic acid groups and sulfonic acid groups. When a base such as sodium hydroxide is used in the fiber washing processes, it is believed that the acid groups react with and neutralize basic groups which are present in the fiber as a result of such washing processes. Above about 60 meq of acid per kg of yarn, product quality and processability deteriorate sharply.

The presence of small amounts of basic material, like sodium hydroxide, in the never-dried poly-p-phenylene terephthalamide fibers prior to heating under the conditions of time and temperature of this invention appear to have little affect on those thermal reactions which yield high molecular weights and inherent viscosities. Thus, when a series of poly-p-phenylene terephthalamide fibers containing 1.5 milliequivalents of sodium hydroxide per kg of fiber were heated in an oven at 550°–640° C. for 7–9 seconds, inherent viscosities were increased to from 7.0 to greater than 20 and moduli to from 1060 to 1244, while tenacities were maintained at greater than 18 gpd. At an oven temperature of 500° C. for about 9 sec, poly-p-phenylene terephthalamide fibers containing this level of base showed no change in inherent viscosity. At high levels of base in the fibers, on the other hand, inherent viscosity was sharply reduced. Thus, about 400 milliequivalents of sodium hydroxide in poly-p-phenylene terephthalamide fibers, even at oven temperature as low as 410° C. for 5 sec, caused a dramatic drop in fiber properties to 3.0 inherent viscosity, 3.7 gpd tenacity and 450 gpd modulus Within the range of temperatures and exposure times of this invention, basicity of up to about 10 meq of base per kg of yarn is acceptable. Within that range, process operability and product properties are acceptable. Above about 10 meq of base, the processability through the heat treatment deteriorates badly and the polymer of the fibers is believed to be severely degraded by that heat treatment through hydrolysis and depolymerization reactions.

Very important to the operation of this invention, is the discovery that increased inherent viscosities result from heat treatments at temperatures of greater than 500° C. of never-dried fibers having an acidity of less than 60, and preferably less than 10, milliequivalents of acid per kg of fiber and a basicity of less than 10, and preferably less than 2, milliequivalents of base per kg of fiber.

Increased inherent viscosity indicates an increase in molecular weight of the polymer which constitutes the fiber product. Fibers of polymer having moderately increased molecular weight exhibit decreased solubility and, also, exhibit increased resistance to deterioration due to moisture and chemical exposure. Fibers of polymer having greatly increased molecular weight, such as indicated by an inherent viscosity of 20, or greater, exhibit complete insolubility. For most uses, the washing medium for practice of this invention should be neutral or slightly basic.

The heat treatment of this invention can be carried out by various means. One embodiment of this invention is in the use of a fluid jet which conducts heated fluid, usually air, nitrogen, or steam, against the fibers to be heat treated. The jet is a so-called forwarding jet which has a fiber introduced at the back end of the jet and conducts the fiber through the jet and out the front in a stream of heated fluid The jet provides turbulent but subsonic movement of heated gas. FIG. 1 depicts a jet which is effective for practice of this invention. The jet includes a fiber introduction back part 1, a fluid introduction body part 2, and a heat treating barrel extender 3. Fiber 4 is introduced into back part 1 at fiber feed orifice 5, is conducted through that part to heat chamber 6, and from there through barrel extender 3.

Heated fluid is introduced into heat chamber 6 by means of conduits 7 which may be present around heat chamber 6 in any number of one or more and, if more than one, substantially equally spaced.

The heated fluid and the fiber to be heat treated are conducted through barrel extender 3 in the same direction, at the same or different speeds. Some of the heated fluid also exits through the fiber feed orifice 5 in the back part 1 so as to avoid entrainment of cool, outside, gases. The speed of the heated fluid is carefully selected to provide high heat transfer from the fluid through the jet device. For the purposes of this invention, it has been concluded that a flow designated by a Reynolds Number of greater than about 10,000 is preferred The Reynolds Number is defined by the following equation:

$$R_e = \frac{\eta v D}{\mu} \text{ wherein}$$

D=Jet diameter
v=heated fluid velocity
$\eta$=heated fluid density
$\mu$=heated fluid viscosity
and all dimensions for those quantities are in consistent units As an example of a determination of Reynolds Number for the practice of this invention, there is taken the use of steam at 40 psig as the heated fluid It is determined that steam under such pressure results in a flow of 2.0 SCFM (standard cubic feet per minute) at a temperature of about 550° C. when the jet diameter (throat) is 0.18 centimeters The effective steam velocity calculates to $2.8\times10^4$ centimeters per second Standard tables give the density of such steam as $9.7\times10^{-4}$: grams per cubic centimeter and the viscosity of such steam as $3.0\times10^{-4}$ poise. The Reynolds Number for this set of conditions is 16,000:

$$Re = \frac{(9.7\times10^{-4})(2.8\times10^{4})(0.18)}{(3.0\times10^{-4})} = 1.6\times10^{4}$$

Use of the jet as a means for heating fibers permits heating convectively at rates of approximately ten times the rate which is obtained using a radiant oven.

The Reynolds Number or the degree of turbulence of gas in the jet has been taken to be substantially independent of the yarn or fiber moving through the jet. The rate of movement of the yarn or fiber through the jet is important only to provide the desired or required heating time As a matter of fact, the turbulent flow of the heated gas can be countercurrent to the movement of the yarn or fiber being heat treated.

Figure 2:
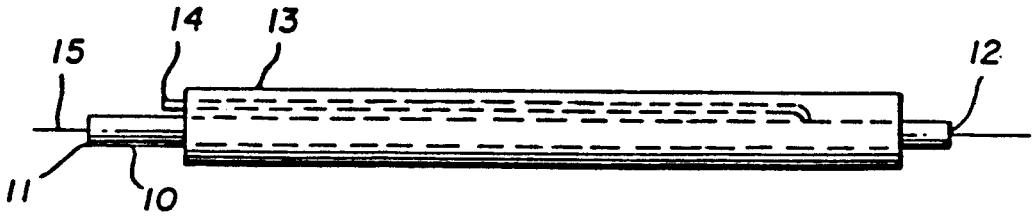

Another embodiment of this invention is in the use of an oven which is fitted with a radient heat source and which provides drying and heat treating energy Without the high relative velocity of fibers and heating fluid which is associated with the jet, previously-described. The oven of this embodiment is usually in the form of a tube or rectangular cavity with dimensions much greater than the fiber to be heat treated. Heated fluid is introduced into the oven at a rate such that there is very little turbulence and the heating forces are primarily radiant in nature. FIG. 2 depicts an oven which is effective for practice of this invention. The oven includes a tube 10 with fiber introduction end 11 and fiber exit end 12. Tube 10 is contained in insulating jacket 13 and there is provision for introducing heated fluid into tube 10 by means of conduits 14 which may be present around tube 10 in any number of one or more and, if more than one, substantially equally spaced Fiber 15 to be heat treated, is conducted through the oven at a speed adequate to permit drying the fiber and exposing the dried fiber to the proper heat energy. The heating fluid is supplied at a rate which is adequate to maintain a desired temperature in the oven and carry evaporated swelling medium away.

The two above-described embodiments for practice of this invention differ, among other ways, in that the jet embodiment utilizes turbulent heated fluid flow with a resultant, very thin boundary layer and very high, substantially convective, heat transfer; the oven embodiment utilizes relatively slow moving, laminar, heated fluid flow with a resultant relatively thick boundary layer and low, substantially radiant, heat transfer.

Due to the different mechanisms of heat transfer in the embodiments of this invention, different results can be expected as a function of the time at which a fiber is heated and the temperature at which the heating takes place As was previously noted, use of the jet embodiment in practice of this invention permits manufacture of fibers having a high Crystallinity Index and use of the oven embodiment permits manufacture of fibers having a high inherent viscosity. It is believed that increasing crystallinity is developed in a fiber by increasing the temperature of the fiber heat treatment and that crystallinity is developed very quickly and is, in fact, developed so quickly that the degree of crystallinity is, practically, a matter of the maximum temperature to which the fiber has been exposed.

It is, also, believed that the reactions leading to increased inherent viscosity are relatively slow processes compared with the rate of crystallization, as discussed above. When fibers are exposed to high temperatures for a time appreciably longer than that required for the increase in crystallization, the reactions leading to increased inherent viscosity will commence. When the rate of heating is relatively slow, branching and cross-linking reactions will compete with the crystallization reaction and limit, to some extent, the ultimate degree of crystallinity which can be obtained.

In view of the above, it can be understood that practice of the jet embodiment, with its rapid heat transfer and high rate of heating, yields heat treated fibers with substantially increased crystallinity and an inherent viscosity which has been increased only slightly. It can, further, be understood that practice of the oven embodiment, with its relatively slow heat transfer and slow rate of heating, yields heat treated fibers with dramatically increased inherent viscosity and a crystallinity which has been increased to a lesser degree.

The description of this invention is directed toward the use of fibers which have been newly-spun and never dried to less than 20 percent moisture prior to operation of the heat treating process. It is believed that previously-dried fibers cannot successfully be heat treated by this process because the heat treatment is effective when performed on the polymer molecules at the time that they are being dried and ordered into a compact fiber structure.

The following test procedures represent descriptions of methods used to evaluate the fibers prepared, in the Examples, as exemplifying the instant invention.

TEST PROCEDURES

Inherent Viscosity

Inherent Viscosity (IV) is defined by the equation:

$$IV = \ln(\eta rel)/c$$

where c is the concentration (0.5 gram of polymer in 100 ml of solvent) of the polymer solution and $\eta$rel (relative viscosity) is the ratio between the flow times of the polymer solution and the solvent as measured at 30° C. in a capillary viscometer. The inherent viscosity values reported and specified herein are determined using concentrated sulfuric acid (96% $H_2SO_4$). Inherent viscosities reported as 20 dl/g or greater are indications that the polymer being tested is insoluble. Fibers of this invention can be insoluble.

Tensile Properties

Yarns tested for tensile properties are, first, conditioned and, then, twisted to a twist multiplier of 1.1. The twist multiplier (TM) of a yarn is defined as:

$$TM = (\text{twists/inch})/(\sqrt{5315/\text{denier of yarn}})$$

The yarns tested in Examples 1–16 and 25–33 were conditioned at 25° C., 55% relative humidity for a minimum of 14 hours and the tensile tests were conducted at those conditions. The yarns tested in Examples 17–24 were conditioned at 21° C., 65% relative humidity for 48 hours and the tensile tests were conducted at those conditions.

Tenacity (breaking tenacity), elongation (breaking elongation), and modulus are determined by breaking test yarns on an Instron tester (Instron Engineering Corp., Canton, Mass.).

Tenacity and elongation are determined in accordance with ASTM D2101-1985 using sample yarn lengths of 25.4 cm and a rate of 50% strain/min.

The modulus for a yarn from Examples 1–16 and 25–33 was calculated from the slope of the secant at 0 and 1% strains on the stress-strain curve and is equal to the stress in grams at 1% strain (absolute) times 100, divided by the test yarn denier.

The modulus for a yarn from Examples 17–24 was calculated from the slope of a line running between the points where the stress-strain curve intersects the lines, parallel to the strain axis, which represent 22 and 27% of full load to break (Full scale to break for 400 denier yarns was 20 pounds and for 1200 denier yarns was 100 pounds). Results from tests of the two methods for determining modulus are believed to be substantially equivalent. For purposes of determining yarn moduli in claim conformance, the method of Examples 1–16 and 25–33 will be used.

Denier

The denier of a yarn is determined by weighing a known length of the yarn. Denier is defined as the weight, in grams, of 9000 meters of the yarn.

In actual practice, the measured denier of a yarn sample, test conditions and sample identification are fed into a computer before the start of a test; the computer records the load-elongation curve of the yarn as it is broken and then calculates the properties.

Yarn Moisture

The amount of moisture included in a test yarn is determined by drying a weighed amount of wet yarn at 160° C. for 1 hour and then dividing the weight of the water removed by the weight of the dry yarn and multiplying by 100.

Acidity and Basicity of Yarn

Residual acid or base in a yarn sample was determined by boiling a weighed, wet, yarn sample (about 20 grams) for one hour in about 200 ml deionized water and about 15 ml 0.1 N sodium hydroxide, and then titrating the solution to neutrality (pH 7.0) with standardized aqueous HCl. The dry weight basis of the yarn sample was determined after rinsing the yarn several times with water and oven drying. The acidity or basicity was calculated as milliequivalents of acid or base per kilogram of dry yarn. The amount of sodium hydroxide added to the solution must be such that the pH of the system remains at pH 11.0 to 11.5 throughout the boiling step of the test.

Moisture Regain

The moisture regain of a yarn is the amount of moisture absorbed in a period of 24 hours at 70° F. and 65% relative humidity, expressed as a percentage of the dry weight of the fiber. Dry weight of the fiber is determined after heating the fiber at 105°–110° C. for at least two hours and cooling it in a dessicator.

Apparent Crystallite Size and Crystallinity Index

Apparent Crystallite Size and Crystallinity Index for poly-p-phenylene terephthalamide fibers are derived from X-ray diffractograms of the fiber materials. Apparent Crystallite size is calculated from measurements of the half-height peak width of the diffraction peak at about 23° (2Θ), corrected only for instrumental broadening. All other broadening effects are assumed to be a result of crystallite size.

The diffraction pattern of poly-p-phenylene terephthalamide is characterized by the X-ray peaks occurring at about 20 and 23° (2Θ). As crystallinity increases, the relative overlap of these peaks decreases as the intensity of the crystalline peaks increases. The Crystallinity Index of poly-p-phenylene terephthalamide is defined as the ratio of the difference between the intensity values of the peak at about 23° and the minimum of the valley at about 22° to the peak intensity at about 23°, expressed as percent. It is an empirical value and must not be interpreted as percent crystallinity.

X-ray diffraction patterns of yarn samples are obtained with an X-ray diffractometer (Philips Electronic Instruments; ct. no. PW1075/00) in reflection mode. Intensity data are measured with a rate meter and recorded either on a strip-chart or by a computerized data collection-reduction system. The diffraction patterns were obtained using the instrumental settings Scanning Speed 1, 20 per minute;

Time Constant 2;

Scan Range 6° to 38°, 2Θ; and

Pulse Height Analyzer, "Differential".

For the 23° peak, the position of the half-maximum peak height is calculated and the 2Θ value for this intensity measured on the high angle side. The difference between this 2Θ value and the value at maximum peak height is multiplied by two to give the peak breadth at half height and is converted to degrees (1 in=4°). The peak breadth is converted to Apparent Crystal Size through the use of tables relating the two parameters.

The Crystallinity Index is calculated from the following formula:

$$\text{Crystallinity Index} = \frac{(A - C) \times 100}{A - D} \text{ where}$$

A=Peak at about 23°,
C=Minimum of valley at about 22°, and
D=Baseline at about 23°.

DESCRIPTION OF THE PREFERRED EMBODIMENTS

Preparation of poly-p-phenylene terephthalamide polymer.

Poly-p-phenylene terephthalamide polymer was prepared by dissolving 1,728 parts of p-phenylenediamine (PPD) in a mixture of 27,166 parts of N-methylpyrrolidone (NMP) and 2,478 parts of calcium chloride cooling to about 15° C. in a polymer kettle blanketed with nitrogen and then adding 3,243 parts of molten terephthaloyl chloride (TCl) with rapid stirring. The solution gelled in 3 to 4 minutes. The stirring was continued for 1.5 hours with cooling to keep the temperature below 25° C. The reaction mass formed a crumb-like product. The crumb-like product was ground into small particles which were then slurried with: a 23% NaOH solution; a wash liquor made up of 3 parts water and one part NMP; and, finally, water.

The slurry was then rinsed a final time with water and the washed polymer product was dewatered and dried at 100° C. in dry air. The dry polymer product had an inherent viscosity (IV) of 6.3, and contained less than 0.6% NMP, less than 440 PPM Ca++, less than 550 PPM Cl—, and less than 1% water.

Spinning and heat treating of fibers are extremely complicated processes. Evaluation of fibers with duplication of test results is often difficult. In the examples of the invention which follow, there are a few yarns with test results outside of limits set for the physical properties of yarns at the edge of the present invention. Such test results outside of the limits set for the invention are few and are generally no farther outside the limits than the expected experimental error.

EXAMPLE 1

This Example describes the preparation of a series of yarns from poly-p-phenylene terephthalamide like that above-prepared which yarns differ from each other primarily in denier and moisture content An anisotropic spinning solution was prepared by dissolving the polymer in 100.1% sulfuric acid so as to produce a 19.3 wt percent solution. The spinning solution was extruded through a spinneret at about 74° C. into a 4 mm air gap followed by a coagulating bath of 10% aqueous sulfuric acid maintained at a temperature of 3° C. in which overflowing bath liquid passed downwardly through an orifice along with the filaments. The spinneret had 134 to 1000 spinning holes (depending on the denier) of 0.064 millimeter diameter. The filaments were in contact with the coagulating bath liquid for about 0.025 seconds. The filaments were separated from the coagulating liquid, forwarded at various speeds (300–475 ypm) depending on the yarn denier desired and washed in two stages In the first stage, water having a temperature of 15° C. was sprayed on the yarns to remove most of the acid. In the second stage, an aqueous solution of sodium hydroxide was sprayed on the yarns followed by a spray of water. In the second stage, the temperature of the liquid sprays was 15° C. Residual acid or base in the yarns was determined as milliequivalents per kg of yarn. The exterior of the yarns was stripped of excess water and yarns were either wound up without drying (yarn moisture of about 85%) or they were partially dried on a steam-heated roll to as low as 35 weight percent yarn moisture based on dried fiber material. The polymer in the yarns so prepared had an inherent viscosity of 5.4 to 5.6. Properties of the series of yarns so produced are given in Table 1. The yarns of this Example, A–G, differed from each other in denier, yarn moisture, and acidity or basicity.

TABLE 1

| Item | Forwarding Speed (ypm) | Denier | Yarn Moisture (%) | Inh. Vis. | Ten. (gpd) | Modulus (gpd) | Acidity(A) or Basicity(B) (meq./kg. of yarn) |
|---|---|---|---|---|---|---|---|
| A | 450 | 2130 | 85 | 5.5 | 24.3 | 513 | 6.30 (A) |
| B | 450 | 2130 | 50 | 5.5 | 24.4 | 523 | 8.65 (A) |
| C | 300 | 1140 | 85 | 5.5 | 26.2 | 545 | 5.50 (A) |
| D | 300 | 1140 | 35 | 5.6 | 26.7 | 532 | 1.46 (B) |
| E | 475 | 400 | 85 | 5.5 | 26.5 | 553 | 8.50 (A) |
| F | 400 | 200 | 85 | 5.4 | 22.6 | 554 | — |
| G | | 1140 | 85 | 5.5 | 24.6 | 436 | — |

EXAMPLES 2–11

These Examples describe the preparation of a series of high modulus, high tenacity, and high inherent viscosity poly-p-phenylene terephthalamide yarns by heat-treating the yarns of Example 1 (items A–F) in an oven.

Each of the wet yarns of Example 1 was tensioned and heat-treated in a 40 ft oven for a given time, temperature and tension. Yarn speeds were in the range of 75–200 ypm and were selected to give the desired residence times The oven was electrically heated and heated the yarns primarily by radiant heat and, only partially, by convective heat. The oven was continuously purged with nitrogen preheated to oven temperature, which, combined with steam from the drying yarn, created a nitrogen/steam atmosphere. The yarn leaving the oven was advanced by a set of water-cooled rolls during which the yarn temperature was reduced to about 25° C. The oven treating conditions for Examples 2–11 are given in Table 2, while the properties of the heat treated yarns are given in Table 3.

TABLE 2

| HEAT TREATING CONDITIONS | | | | |
|---|---|---|---|---|
| Example | Feed Yarn Example 1, Item | Oven Temp. (°C.) | Heating Time (Sec.) | Tension (gpd) |
| 2 | A | 660 | 8.0 | 3.0 |
| 3 | B | 640 | 10.7 | 3.0 |
| 4 | C | 600 | 6.7 | 2.0 |
| 5 | C | 625 | 6.7 | 2.0 |
| 6 | D | 550 | 8.9 | 2.0 |
| 7 | D | 600 | 8.9 | 2.0 |
| 8 | D | 640 | 6.7 | 2.0 |
| 9 | E | 550 | 4.0 | 2.2 |
| 10 | E | 600 | 6.0 | 2.2 |

TABLE 2-continued

| HEAT TREATING CONDITIONS | | | | |
|---|---|---|---|---|
| Example | Feed Yarn Example 1, Item | Oven Temp. (°C.) | Heating Time (Sec.) | Tension (gpd) |
| 11 | F | 540 | 5.0 | 1.8 |

TABLE 3

| HEAT-TREATED YARN PROPERTIES | | | | | | | |
|---|---|---|---|---|---|---|---|
| Example | Denier of Treated Yarn | Tenacity (gpd) | Modulus (gpd) | Elong. at Break (%) | Inh. Vis. (dl/g) | Crystalinity Index (%) | Moisture Regain (%) |
| 2 | 2110 | 18.7 | 1142 | 1.5 | >20.0 | 72 | — |
| 3 | 2087 | 18.6 | 1136 | 1.6 | 13.9 | 72 | — |
| 4 | 1112 | 21.0 | 1101 | 1.8 | 7.0 | 72 | 1.2 |
| 5 | 1100 | 19.6 | 1193 | 1.6 | 8.8 | 73 | 1.0 |
| 6 | 1130 | 21.9 | 1061 | 1.9 | 7.0 | 70 | — |
| 7 | 1124 | 19.7 | 1166 | 1.6 | 15.0 | 72 | — |
| 8 | 1117 | 18.8 | 1244 | 1.5 | >20.0 | 74 | — |
| 9 | 369 | 22.4 | 1094 | 1.9 | 6.4 | 73 | — |
| 10 | 371 | 19.1 | 1261 | 1.5 | 14.2 | 74 | 0.9 |
| 11 | 188 | 19.9 | 1102 | 1.7 | 6.3 | 72 | — |

These examples indicate that the poly-p-phenylene terephthalamide yarns of this invention with moduli greater than about 1100 gpd, inherent viscosities greater than about 6.5, tenacities greater than !8 gpd, and crystallinity indices at least 70%, were prepared using the following oven heating conditions: oven temperature greater than 500° C. (preferably 550°-660° C.), heating times 4-11 sec., and tension 1.5-3.0 gpd. Note that the polymers of Examples 2 and 8 are insoluble.

EXAMPLE 12

A 380 denier, poly-p-phenylene terephthalamide yarn with 85% yarn moisture (feed yarn, Example 1E, Table 1) was heat-treated in an oven at 640° C.: for 5.75 seconds by the same general procedure of Examples 2-11, except that the tension, during heating, was only 0.75 gpd. The yarn so produced exhibited a tenacity of 15.8 gpd and a modulus of 1045 gpd. At a tension of about 2 gpd, the modulus of the yarn of this Example 12 would have been expected to be greater than 1250 gpd and the tenacity greater than 18 gpd for the time and temperature utilized (see Example !0 in Tables 2 & 3 for comparison). cl EXAMPLES 13-16

These Examples describe the oven heat-treatment of 400 and 1140 denier polY-p-phenYlene terephthalamide yarns at less than the preferred temperatures.

Feed yarns (Example 1, Items C, D & E) were heat-treated in an oven by the same general manner as in Examples 2-11, except that the temperatures were 450°-500° C. Specific heating conditions for each Example, 13 through 16, are listed in Table 4. Heat-treated yarn properties are given in Table 5. None of the yarns of these examples exhibit the combination of modulus-/inherent viscosity/tenacity/crystallinity index which represent the yarns of this invention; that is, both the moduli and inherent viscosities fall below the desired range.

TABLE 4

| Example | Feed Yarn Example 1 Item | Yarn Moisture (%) | Oven Temp. (°C.) | Heating Time (Sec.) | Tension (gpd) |
|---|---|---|---|---|---|
| 13 | E | 85 | 450 | 6.0 | 2.2 |
| 14 | E | 85 | 500 | 6.0 | 2.2 |
| 15 | C | 85 | 500 | 8.9 | 2.0 |
| 16 | D | 35 | 500 | 8.9 | 2.0 |

TABLE 5

| Example | Denier | Tenacity (gpd) | Modulus (gpd) | Elong. at Break (%) | Inh. Vis. (dl/g) | C.I. (%) | Moisture Regain (%) |
|---|---|---|---|---|---|---|---|
| 13 | 370 | 23.4 | 1058 | 2.1 | 5.2 | 70 | 1.2 |
| 14 | 373 | 22.5 | 103 | 2.0 | 5.4 | 70 | 1.5 |
| 15 | 1119 | 23.2 | 986 | 2.2 | 5.5 | 70 | — |
| 16 | 1141 | 23.0 | 1005 | 2.2 | 5.7 | 68 | — |

EXAMPLES 17-22

These Examples describe the preparation of a series of high modulus, high tenacity and highly crystalline poly-p-phenylene terephthalamide yarns by heat-treating never-dried feed yarns under tension in a forwarding jet For each of these Examples, yarn from Example 1, Item E for all Examples except 18 and Item G for Example 18, above, was immersed in water. An end from the immersed yarn was passed through a tension gate and onto a feed roll. The resulting yarn moisture was about 100%. From the feed roll, the yarn was passed through a forwarding jet of the type shown in FIG. 1 with a barrel extender which made the overall length of the jet eight inches. In the jet, the yarn was dried and heat-treated with superheated steam or heated air, depending on the specific Example. From the jet, the yarn was passed over a draw roll so as to maintain tension on the yarn (between 2 and 4 gpd depending on the Example) in the heat-treating zone, and thence to a wind-up roll. Water was applied to the yarn just after the jet to reduce static bloom. Table 6 contains the specific feed yarn and jet conditions used for each Example, while Table 7 provides the properties of the heat-treated yarns so produced.

The yarns of Examples 17–22 exhibit a combination of high modulus (greater than 1100 gpd), high tenacity (greater than 18 gpd) and high crystallinity (crystallinity index, at least 76%), and Apparent Crystal Size, at least 74Å).

EXAMPLES 23–24

These two examples describe the preparation of poly-p-phenylene terephthalamide yarns by the jet heat-treating procedures described in Examples 17–22, except that the exposure times at 500° C. were too long and too short, respectively, to give yarns with the desired combination of properties. Processing conditions are given in Table 6 and yarn properties in Table 7. At the short heating time of 0.5 sec. at 500° C. for Example 25, both the modulus (1053 gpd) and crystallinity properties (Crystallinity Index, 72%; Apparent Crystal Size, 71Å) of the yarn were outside of the desired range. At the long heating time of 2.5 sec. at 500° C., the yarn tenacity (16.7 gpd) fell below the desired range.

TABLE 6

| Example | Moisture on Yarn (%) | Yarn Speed (m/m) | Gas Atm. | Press. (psig) | Gas Temp. (°C.) | Flow Rate (SCFM) | Tension (gpd) | Residence Time (sec) | Reynolds (× 1000) |
|---|---|---|---|---|---|---|---|---|---|
| 17 | 100 | 17 | air | 40 | 550 | 1.9 | 4.0 | 0.7 | 22 |
| 18 | 100 | 17 | steam | 80 | 600 | 2.7 | 3.8 | 0.7 | 26 |
| 19 | 100 | 25 | steam | 40 | 600 | 1.8 | 2.0 | 0.5 | 14 |
| 20 | 100 | 50 | steam | 40 | 600 | 1.8 | 2.2 | 0.25 | 14 |
| 21 | 100 | 15 | steam | 40 | 500 | 2.0 | 2.0 | 0.8 | 18 |
| 22 | 100 | 10 | steam | 40 | 500 | 2.0 | 2.0 | 1.3 | 18 |
| 23 | 100 | 5 | steam | 40 | 500 | 2.0 | 2.0 | 2.5 | 18 |
| 24 | 100 | 25 | steam | 40 | 500 | 2.0 | 2.0 | 0.5 | 18 |

TABLE 7

| Example | Denier | Tenacity (gpd) | Break Elong. (%) | Modulus (gpd) | Crystal. Index (%) | Appar. Crystal. Size (Å) | Moisture Regain (%) | Inherent Viscos. (dl/g) |
|---|---|---|---|---|---|---|---|---|
| 17 | 377 | 18.6 | 1.5 | 1141 | 79 | 78 | 1.2 | 5.7 |
| 18 | 1165 | 19.7 | 1.5 | 1304 | 76 | 74 | 1.0 | 5.5 |
| 19 | 375 | 20.2 | 1.5 | 1278 | 76 | 77 | 1.1 | 6.7 |
| 20 | 363 | 19.1 | 1.4 | 1268 | 77 | 78 | 1.1 | 5.4 |
| 21 | 376 | 18.1 | 1.5 | 1125 | 76 | 74 | 1.4 | 5.8 |
| 22 | 377 | 18.3 | 1.5 | 1145 | 77 | 76 | 1.4 | 6.0 |
| 23 | 372 | 16.7 | 1.4 | 1183 | 77 | 77 | 1.2 | 6.0 |
| 24 | 370 | 19.0 | 1.7 | 1053 | 72 | 71 | 2.4 | 5.0 |

EXAMPLES 25–33 AND COMPARISON EXAMPLES C1–C7

Examples 25–33 and Comparison Examples C1–C7 describe the preparation of a series of poly-p-phenylene terephthalamide yarns using rinsing and washing processes which result in varying levels of acidity and basicity.

A series of nominally 400 denier (267 filaments per yarn) poly-p-phenylene terephthalamide yarns was prepared as described in Example 1 except that the second stage of washing for yarns in this series was varied from water sprays to sprays of caustic solution with increasing concentration of sodium hydroxide ranging from 0.1 to 1 8%, followed by sprays of water or caustic solution with concentrations ranging from 0.01 to 0.5%. Residual acid or base in the yarns ranged from as high as 136 meq of acid per kg of yarn, through essentially neutral yarns, to as high as 106 meq of base per kg of yarn. The exterior of the yarns was stripped of excess water and the yarns were wound up without drying (yarn moisture of about 85%)

The yarns prepared as above were tensioned and heat-treated in an oven (17 in long) at 600° C. for 5.7 sec at a tension of 2.0–2.5 gpd. The properties of the yarn before and after heat treatment are given in Table 8.

It can be seen from Table 8 that yarns having acidity levels up to acidity of about 60 (Examples 25–30) gave acceptable processability during oven heating, high modulus, good strength retention and high inherent viscosity. Above acidity of about 60, yarn processability deteriorated abruptly, such that the yarn broke under processing tensions and could not be strung up (Comparison Examples C1–C3).

On the basic side, spun yarns with basicity up to about 10 could be successfully processed, and the properties of the resulting oven-treated yarns were acceptable (Examples 31–33). At basicity of greater than about 10, yarn properties and processability deteriorated (Comparison Examples C4–C7).

TABLE 8

| Example | Before Heating: Acidity or basicity (Meq/kg) | Before Heating: Inher. Viscos. (dl/g) | Operability during heating | After Heating: Mod. (gpd) | After Heating: Strgth Reten. (%) | After Heating: Inher. Viscos. (dl/g) |
|---|---|---|---|---|---|---|
| C1 | 136 Acid | 5.4 | Oven breaks Can't string up | — | — | — |
| C2 | 123 Acid | 5.2 | Oven breaks Can't string up | — | — | — |
| C3 | 65 Acid | 5.6 | Oven breaks Can't string up | — | — | — |
| 25 | 54 Acid | 5.7 | Acceptable | 1160 | 73 | >20 |
| 26 | 42 Acid | 5.6 | Acceptable | 1180 | 68 | 17.0 |
| 27 | 24 Acid | 5.2 | Acceptable | 1150 | 64 | 16.5 |
| 28 | 21 Acid | 5.9 | Acceptable | 1170 | 66 | 9.5 |
| 29 | 7 Acid | 5.7 | Acceptable | 1180 | 58 | 10.5 |
| 30 | 4 Acid | 5.1 | Acceptable | 1151 | 60 | 8.5 |
| 31 | 2 base | 5.3 | Acceptable | 1064 | 54 | 8.8 |
| 32 | 4 base | 5.6 | Acceptable | 1140 | 58 | 8.7 |
| 33 | 8 base | 5.7 | Acceptable | 1084 | 50 | 8.2 |
| C4 | 14 base | 4.5 | Oven breaks Can't string up | — | — | — |
| C5 | 23 base | 5.4 | Poor process continuity | 1103 | 48 | 7.0 |
| C6 | 63 base | 4.8 | Poor process continuity | 1061 | 50 | 4.3 |
| C7 | 106 base | 5.8 | Oven breaks Can't string up | — | — | — |

What is claimed:

1. A fiber of poly-p-phenylene terephthalamide having a modulus of greater than 1100 grams per denier, a tenacity of greater than 18 grams per denier, an elongation of less than 2.0%, a moisture regain of less than 1.5%, an inherent viscosity of 5.5 to 20, and a Crystallinity Index of 70–85%, wherein inherent viscosity (IV) is defined by the equation:

$$IV = \ln(\eta_{rel})/c$$

where c is the concentration (0.5 gram of polymer in 100 ml of solvent) of a solution of poly-p-phenylene terephthalamide in 96% sulfuric acid as a solvent and $\eta_{rel}$ is the ratio between flow times of the solution and the solvent as measured as 30° C. in a capillary viscometer and wherein Crystallinity Index is defined as the ratio of the difference between intensity values of the X-ray peak of a diffraction pattern of poly-p-phenylene terephthalamide at 23° and the minimum of the valley at 22° to the X-ray peak intensity of a diffraction pattern of poly-p-phenylene terephthamide at 23°, expressed as percent.

2. A fiber of poly-p-phenylene terephthalamide having a modulus of greater than 1100 grams per denier, and a tenacity of greater than 18 grams per denier, an elongation of less than 2.0%, a moisture regain of less than 1.5%, and a Crystallinity Index of 75–85%, the polymer of said fiber having an inherent viscosity of 6.5 to 20, wherein inherent viscosity (IV) is defined by the equation:

$$IV = \ln(\eta_{rel})/c$$

where c is the concentration of (0.5 gram of polymer in 100 ml of solvent) of a solution of poly-p-phenylene terephthalamide in 96% sulfuric acid as a solvent and $\eta_{rel}$ is the ratio between flow times of the solution and the solvent as measured at 30° C. in a capillary viscometer and wherein Crystallinity Index is defined as the ratio of the difference between intensity values of the X-ray peak of a diffraction pattern of poly-p-phenylene terephthalamide at 23° and the minimum of the valley at 22° to the X-ray peak intensity of a diffraction pattern of poly-p-phenylene terephthamide at 23°, expressed as percent.

* * * * *